United States Patent [19]

Daniels

[11] Patent Number: 5,040,522

[45] Date of Patent: Aug. 20, 1991

[54] PASSIVE FLEXION CHAIR FOR PHYSICAL THERAPY

[76] Inventor: Michael Daniels, 7 Terrace Cir. #1F, Great Neck, N.Y. 11021

[21] Appl. No.: 620,036

[22] Filed: Nov. 30, 1990

[51] Int. Cl.[5] ..... A61H 1/02

[52] U.S. Cl. ..... 128/25 R; 297/466; 272/144

[58] Field of Search ..... 297/464, 466, 411, 415, 297/DIG. 4; 272/130, 134, 141, 144; 128/24 R, 25 R, 25 B, 33, 70–74; 269/322, 328

[56] References Cited

U.S. PATENT DOCUMENTS

| | | | |
|---|---|---|---|
| 4,462,252 | 7/1984 | Smidt et al. | 272/125 X |
| 4,549,555 | 10/1985 | Fraser et al. | 128/25 R X |
| 4,691,694 | 9/1987 | Boyd et al. | 128/25 R |
| 4,702,108 | 10/1987 | Amundsen et al. | 272/134 X |
| 4,732,381 | 3/1988 | Skowronski | 272/134 |
| 4,802,462 | 2/1989 | Reiss et al. | 272/134 X |
| 4,813,746 | 3/1989 | Mulholland | 297/464 X |
| 4,836,536 | 6/1989 | Jones | 272/134 |

FOREIGN PATENT DOCUMENTS

| | | | |
|---|---|---|---|
| 639715 | 4/1928 | France | 297/466 |

*Primary Examiner*—Robert Bahr
*Assistant Examiner*—Linda C. M. Dvorak
*Attorney, Agent, or Firm*—Michael I. Kroll

[57] ABSTRACT

A flexion chair apparatus for the continuous passive motion treatment is disclosed, for use in the physical rehabilitation of a knee joint, which allows a patient to be so treated in a sitting upright position while not requiring the patient's leg to be lifted above the ground. The apparatus of the invention includes a seat and back support, as well securement for the patient's leg and a flexing of his or her knee joint. The seat portion of the apparatus is provided with an elevator which allows the seat to be vertically and continuously or discontinuously raised and lowered during the treatment process. Securement of the patient's leg includes a support bar which runs substantially along the length of the patient's entire leg and which includes a joint adjacent to the patient's knee joint. The support bar of the invention is capable of being raised or lowered in response to a vertical movement of the seat. The patient's foot is secured to the ground in a fixed manner which does not permit it to be raised.

13 Claims, 5 Drawing Sheets

14
10
20
20AC
30
28
20AA
20A
26
20AB
12
20B
20BA
16
30
18AA
20BB
24A
18AC
22
26
18A
28
18
18AB
18BA
18B
18BB
A
B
34
C
D
E
32
24B
25

A — UP CONTROL (SLOWLY ASCENDING TO INITIAL START POSITION)

B — DOWN CONTROL (MAXIMUM OF 1 PUSH) EACH INCREMENT

C — VARIABLE SPEED CONTROL FOR RATE OF DROP

D — 1° TO 5° ADJUSTABLE DROP CONTROL (PER PUSH OF DOWN CONTROL)

E — ° TOTAL DROP CONTROL (SETTING FOR LIMITING TOTAL °S DOWN)

Fig. 4
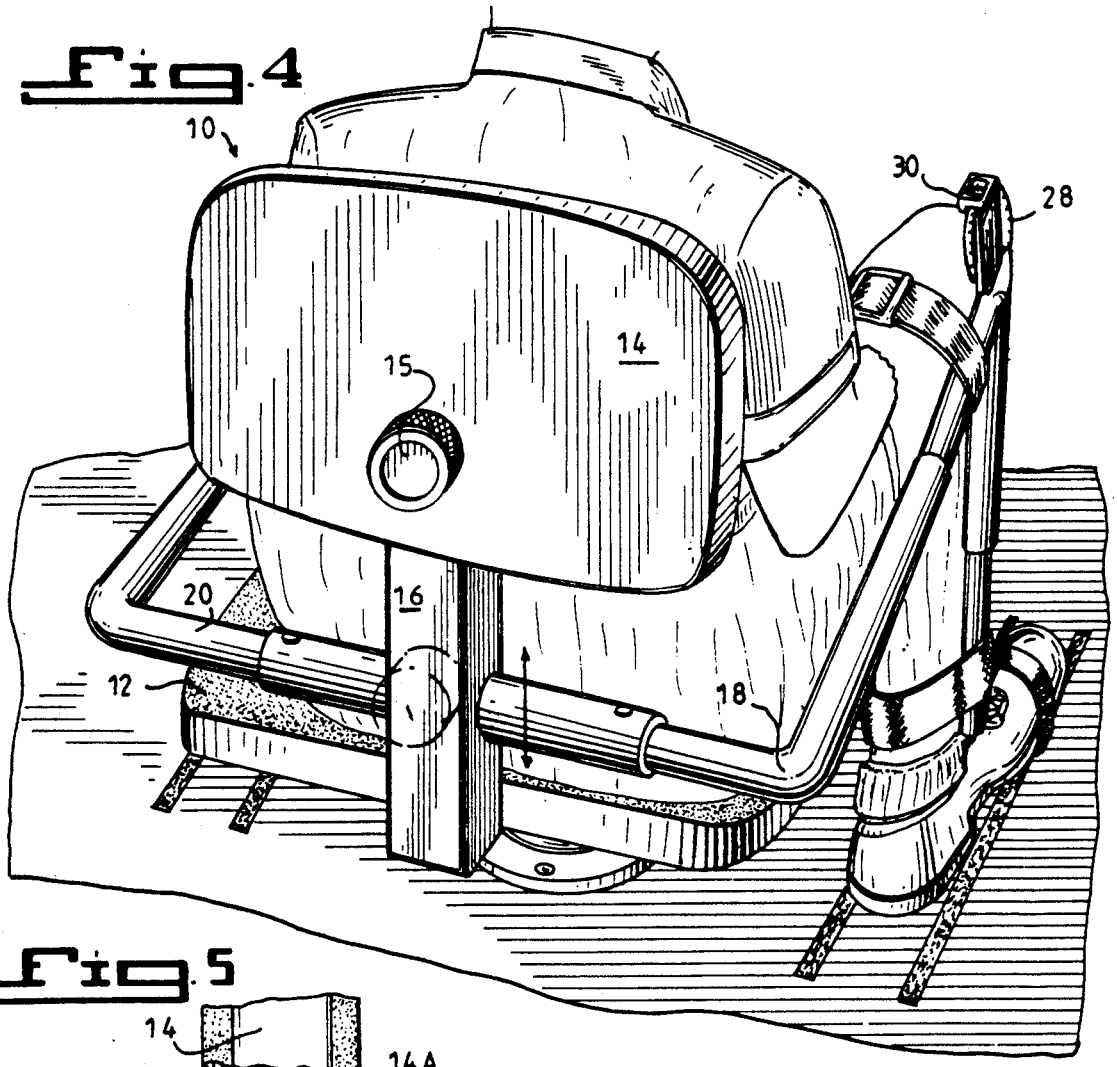
Fig. 5
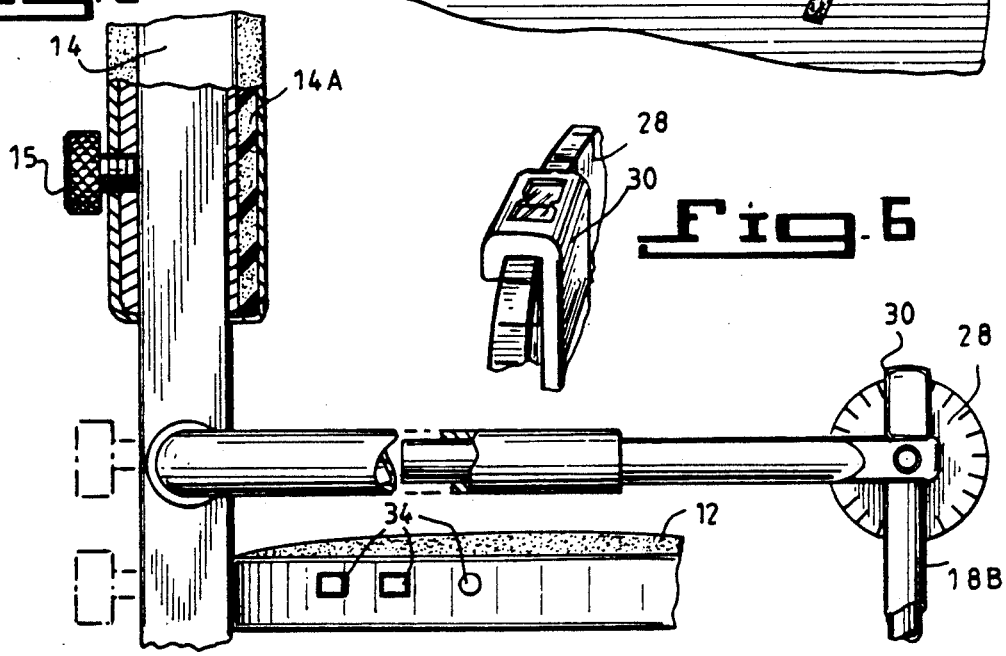
Fig. 6

(FREE STANDING)

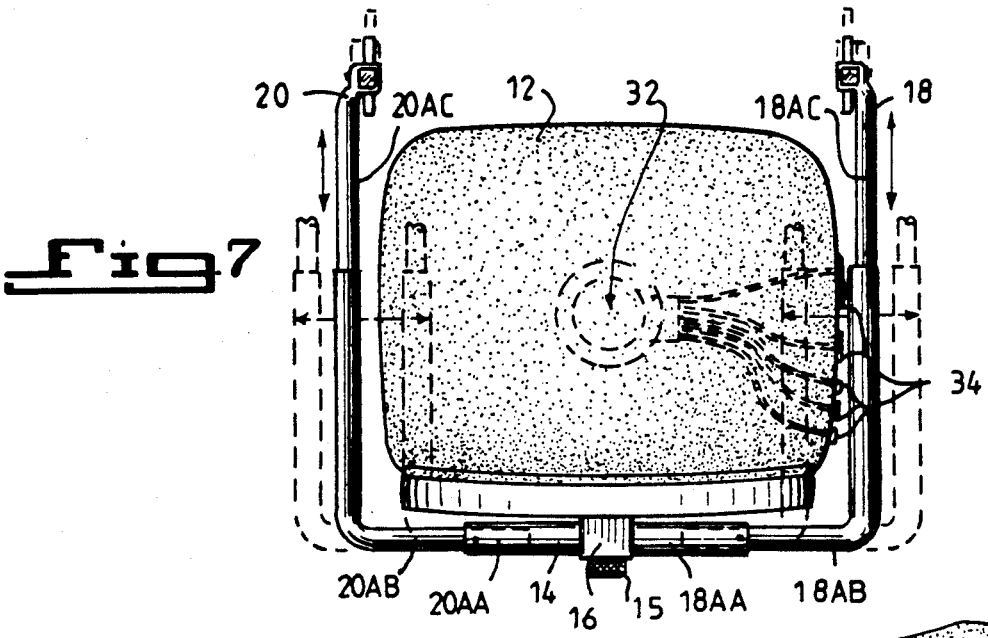
Fig 7
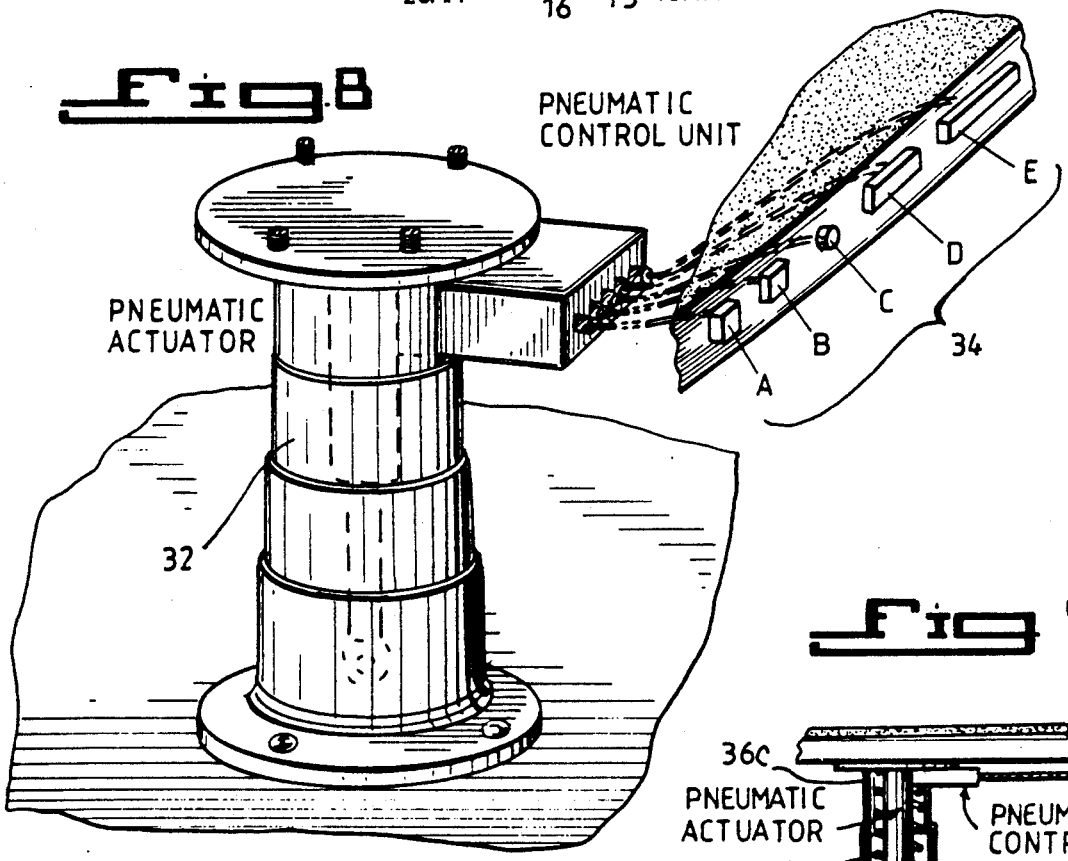
Fig 8
Fig 9
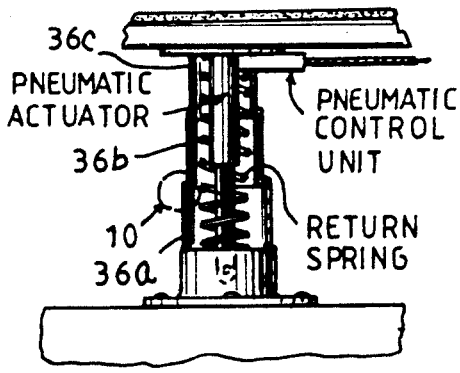
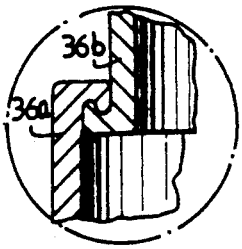
Fig 10

PASSIVE FLEXION CHAIR FOR PHYSICAL THERAPY

BACKGROUND OF THE INVENTION

1. Field of the Invention

The present invention relates, generally, to a passive flexion chair for physical therapy. More particularly, the present invention relates to an apparatus for imparting passive motion flexion to a lower limb of a person, such as, for example, the knee of a person recovering from an injury. Such apparatus are generally known in the relevant art as continuous passive motion ("CPM") systems.

When a joint, such as one's knee, is immobilized due to an injury, disease, etc., the soft tissues at the joint begin to contract. As a consequence of such contraction, motion of the joint is limited both by actual physical restraint, as well as by psychological restraints wherein a patient either experiences pain as a result of movement of the joint or, at a minimum, fears the pain which might result from stretches of the soft tissues of the joint beyond a certain point. However, in order to return the joint to its normal range of mobility, the soft tissues, over time, must be stretched in order to increase the range of motion of the joint.

Stretching of the soft tissues of the joint is best carried out by passive manipulation of the joint, since the muscles that operate the joint are in a weakened condition as a result of the injury. During the manipulation of the joint, pain will result as scar tissue and adhesions are broken off. The pain encountered during passive manipulation of the joint must be strictly controlled and always held below the patient's allowable tolerance for pain. If a patient's allowable tolerance for pain is exceeded, new and painful adhesions could be formed and result in a regression in the patient's joint condition.

Operation in a comfort zone within the patient's allowable tolerance for pain is also important since stretching of the soft tissues is facilitated as the patient relaxes and tense muscles are overcome by weariness. A sitting position facilitates the relaxation of muscles surrounding the injured area.

To continually assure operation in the comfort zone, the stretching necessarily must be carried out gradually and over an extended period of time.

Because of the requirement that the stretching therapy must take place over an extended period of time, uniform and continuous mechanical therapy is both practical and required, as opposed to relying solely upon manual therapy by a trained physical therapist. The reasons for this include the fact that a physical therapist will not have the stamina to continue the treatment in a uniform and consistent manner over an extended period of time. The mechanical method may allow for a more accurate measurement of progress. This is true during individual therapeutic sessions, as well as over time from session-to-session. By contrast, the passive flexion chair of the present invention, as will be described in detail hereinafter, will ensure a continuous and uniform treatment over an extended period of time, as well as allowing the patient to continuously adjust and re-adjust the degree of stretching.

Additionally, the monetary cost of contracting a professional physical therapist for constant and total involvement in the healing process, over an extended period of time, will quickly become prohibitive. By contrast, the passive flexion chair of the present invention can manipulate the joint to be treated over an extended period of time without the physical therapist being in attendance, thereby considerably reducing the cost of treatment.

Further, a skilled therapist must generally rely a upon trial-and-error approach, through his or her sense of feel, in order to establish the range of motion of the joint that was attained in the previous treatment, so as to use it as a starting point for the next treatment, to establish a specific desired angle through which the joint is able to be reciprocated during treatment, and to establish a specific desired force to be applied during treatment for the next desired range of motion. The passive flexion chair ("PFC") provides a consistent and accurate method for measurement in tracking the progress attained during previous treatments.

Overall, the present invention, as to be described below, provides for an accurate control of the angle through which the joint is reciprocated during passive manipulation and of the amount of force applied during the manipulation.

The apparatus of the present invention further provides a passive knee flexion device which is very easy to utilize by the patient in terms of its controls and set up and, further, in terms of mounting and dismounting from the apparatus by the patient.

Other applications and benefits of the present invention will become readily apparent as the apparatus of the present invention is described in further detail below.

DESCRIPTION OF THE PRIOR ART

Devices are generally known to the prior art which are designed to impart a continuous passive motion for limbs of a patient undergoing physical therapy. Such devices are generally disclosed in Nicolosi et. al., U.S. Pat. No. 4,089,330, entitled "Physical Therapy Apparatus and Method," issued May 16th, 1978; Krukowski, U.S. Pat. No. 4,628,910, entitled "Muscle Exercise and Rehabilitation Apparatus," issued Dec. 16th, 1986; Farris et. al., U.S. Pat. No. 4,665,899, entitled "Apparatus for Articulating the Knee and Hip Joints," issued May 19th, 1987; Carlson et. al., U.S. Pat. No. 4,776,587, entitled "Leg Exercise Machine," issued Oct. 11th, 1988; Wright, U.S. Pat. No. 4,807,601, entitled "Live Display Apparatus for Setting Extension and Flexion Limits in Continuous Passive Motion (CPM) System," issued Feb. 28th, 1989; Genovese et. al., U.S. Pat. No. 4,825,852, entitled "Continuous Passive Motion Device," issued May 2nd, 1989; Bond et. al., U.S. Pat. No. 4,905,676, entitled "Exercise Diagnostic System and Method," issued Mar. 6th, 1990; Pecheux, U.S. Pat. No. 4,905,677, entitled "Apparatus for the Mobilization of a Lower Limb," issued Mar. 6th, 1990; Akcelrod et. al., U.S. Pat. No. 4,922,892, entitled "Apparatus for Resistive Extension and Flexion of the Leg," issued May 8th, 1990; and, Saringer, U.S. Pat. No. 4,930,497, entitled "Apparatus for Imparting Continuous Passive Motion to a Lower Limb," issued June 5th, 1990.

In contrast to the present invention, the devices disclosed by the cited prior art are extremely complex and often require the assistance of a trained professional to instruct the patient on how to properly utilize the passive motion apparatus. The apparatus of, for example, Nicolosi et. al. requires the use of a variable weight means, along with a pulley, in order to impart the continuous motion required.

The passive flexion chair of the invention, it should be stressed, is not necessarily a continuous motion machine. Rather, it helps the patient reach a degree of flexion previously unattained. When at such a point, the patient remains in this position as long as the resulting pain is tolerable. At each session, the patient is encouraged to reach a greater degree of flexion then attained in the previous session.

Krukowski discloses a muscle exercise and rehabilitation apparatus which, like the present invention, may be used to provide a continuous passive motion to a joint, such as a patient's knee, however, unlike the present invention, the apparatus disclosed by Krukowski is designed to grip the lower leg of the patient below the knee and actually raise the leg of the person above the ground. The securement of the patient's leg is accomplished in a manner that would either permit the patient's leg to slip through the securement device or otherwise require that the patient's leg be secured, or held above the ground, by allowing the gripping means to contact the knee joint to be treated. In any event, it can be expected that such device would result in greater discomfort.

The present invention, unlike the device in Krukowski, does not require that the patient's foot be lifted off of the ground, thereby avoiding a mode of additional stress upon the knee joint to be treated. Additionally, the PFC is not a continuous motion machine and, unlike Krukowski, will allow the knee joint to be bent at an angle beyond 90°; the Krukowski device is a CPM device limited to bending the joint solely between angle of 0° to 90°.

The continuous motion apparatus further disclosed by Carlson et. al. and Bond et. al. suffer from drawbacks similar to those inherent in the Krukowski device in that the Carlson et. al. and Bond et. al. devices require that the patient's leg be lifted from the ground for the imparting the desired treatment. Additionally, the devices disclosed in such prior art, i.e., CPM apparatus, are not functional in attaining the greater degrees of flexion attainable with the claimed invention.

Finally, the devices for continuous passive motion disclosed in Farris et. al., Wright, Genovese et. al., Akcelrod et. al., Pecheux and Saringer all require that the patient to be treated be so treated in a reclined position, which is not a position in which the patient would naturally exert stress on the joint being treated, particularly the patient's knee joint. It is submitted that it is far more preferable that the patient being treated receive therapy in a manner which is consistent with the eventual re-use of the joint being attended to.

SUMMARY OF THE INVENTION

It is, therefore, an object of the present invention to provide a flexion chair apparatus for the passive motion treatment of a knee joint which will fulfill the needs heretofore recognized and lacking in the prior art.

It is a further object of the present invention to provide a flexion chair apparatus for the passive motion treatment of a knee joint which, when in use, will not place additional and undesirable stress on the joint being treated by requiring that the patient's entire leg be lifted from the ground.

It is, yet, a further object of the present invention to provide a flexion chair apparatus for the passive motion treatment of a knee joint which will allow the patient to be treated in an upright sitting position, as opposed to being treated in a manner in which the patient would not likely utilize the joint once fully healed.

It is a further object of the present invention to provide a flexion chair apparatus for the passive motion treatment of a knee joint which, when in use, will assist the patient in attaining a greater degree of flexion then possible when using a CPM machine. The PFC of the present invention is designed to replace the uncertainty and lack of uniformity found in conventional manual methods, presently practiced in physical therapy environments.

It is an additional object of the present invention to provide a flexion chair apparatus for the passive motion treatment of a knee joint which may be economically manufactured and offered for sale.

The foregoing and related objects are accomplished by a flexion chair apparatus for the passive motion treatment, for use in the physical rehabilitation of a knee joint, which allows a patient to be so treated in a sitting upright position while not requiring the patient's leg to be lifted above the ground. The apparatus of the invention includes a seat and back support, as well as means for securing the patient's leg and flexing his or her knee joint. The seat portion of the apparatus of the present invention is provided with elevator means which allow the seat to be vertically raised and lowered during the treatment process. The securement means for the patient's leg includes a support bar which runs substantially along the length of each of the patient's entire leg and which includes a joint adjacent to the patient's knee joint. The support bar of the invention is capable of being raised or lowered in response to a vertical movement of the seat. The patient's foot is secured to the ground in a fixed manner which does not permit it to be raised.

In use, as will be explained in greater detail below in conjunction with the accompanying drawing figures, when the chair, or seat, on which the patient is seated is lowered, the patient's knee joint is flexed. The greater the extent to which the seat of the invention is lowered, i.e., the greater the range or distance of the vertical movement of the seat supporting the patient is lowered the greater is the angle of flex applied to the knee joint of the patient.

In preferred embodiments of the present invention, the patient may set both the speed of the vertical movement of the chair of the invention, as well as also setting the range of vertical movement. The range of vertical movement is preferably set according to the degree of joint flex intended as part of the treatment, as medically prescribed, at any given point in the treatment.

In a particularly preferred embodiment of the present invention, the physical therapist and/or patient is able to regulate the descent of the chair, i.e., its range of vertical movement, by adjustment of the descent in interval of degrees of flex, e.g., 1°- or 5°-drop control.

The apparatus of the invention may be constructed so that either one leg or both legs of a patient are secured for treatment by respective floor restraints.

The foot, or feet, of the patient may be secured to the floor by countless means, all of which are within the scope of the present invention. One such means would be to provide at least one strap which would encircle the foot of the patient. This strap would then be secured to the floor. One such means of securement would entail the use of Velcro (registered trademark of the Velcro Corporation.) An outer portion of the strap, or straps, encircling the foot of the patient would be provided with one-half of the hook-and-loop arrangement of the Velcro employed. The complementary half would be provided in a secured manner to the floor, or other base.

To the accomplishment of the above and related objects, the present invention may be embodied in the form illustrated in the accompanying drawing figures, attention being called to the fact, however, that the drawing figures are intended to be illustrative only, and that changes may be made in the specific construction illustrated and described within the scope of the appended claims.

BRIEF DESCRIPTION OF THE DRAWING FIGURES

In the drawing, wherein similar reference numerals denote similar features throughout the several views.

Figures 2, 3:
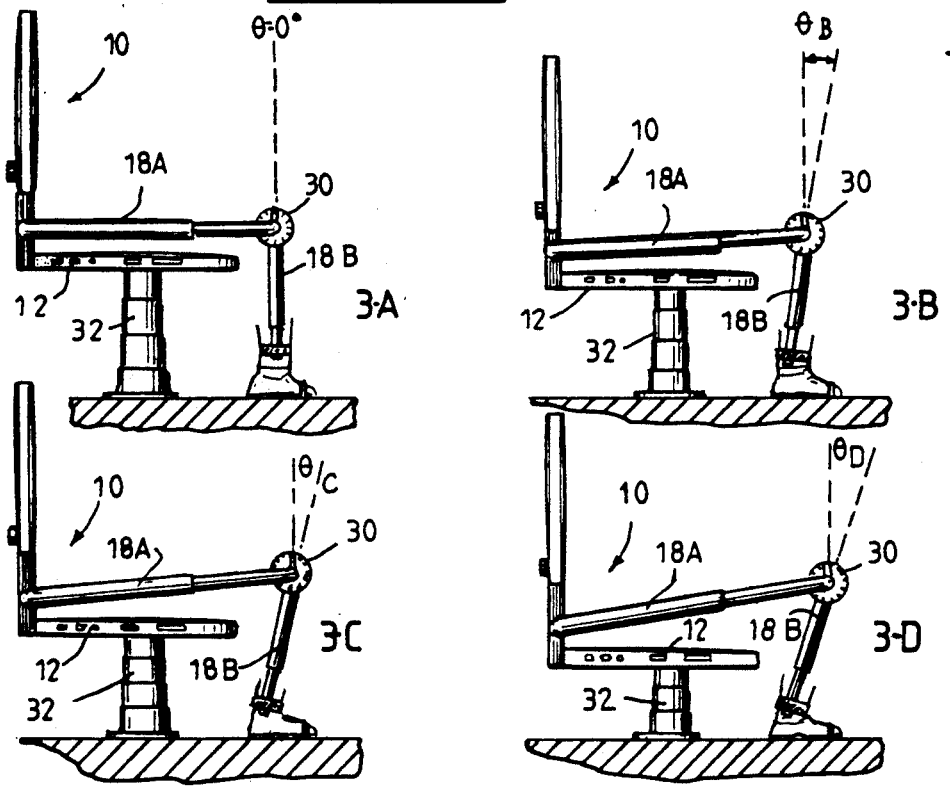
FIG. 2 is an illustrative listing of the controls which may be activated by the user of the passive flexion chair physical therapy apparatus of the present invention.
Figure 6A:
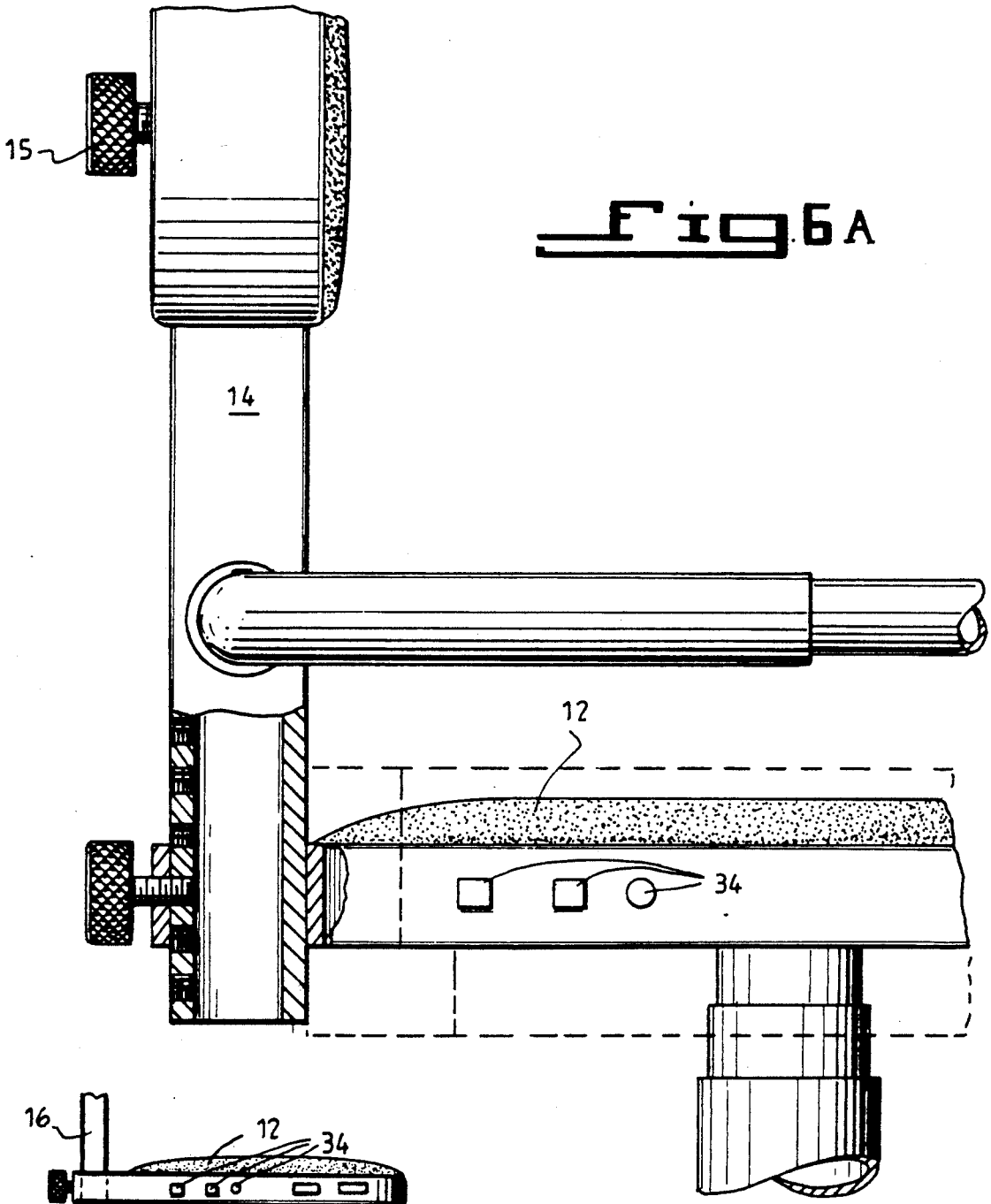
Figure 6B:
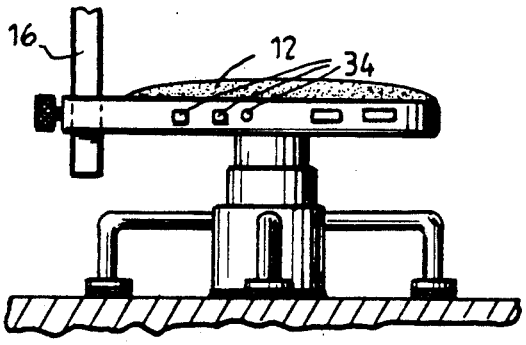

FIG. 3 presents four modes, or points, during the vertical, i.e., descent, motion of the chair of the physical therapy apparatus of the present invention illustrating how the joint of a patient would be flexed by the claimed apparatus; the four points being designated as FIGS. 3-A, 3-B, 3-C and 3-D;

FIG. 4 shows a prospective, rear view of the passive flexion chair physical therapy apparatus of the present invention, which includes a back support;

FIG. 5 is a side, elevational view of the passive flexion chair physical therapy apparatus of the present invention with the back support of the chair being shown in cross-section, partially broken away;

FIG. 6 is a prospective view illustrating the protractor of the invention, which is provided at the joint of the support bar, with the protractor having magnification means, such as a magnifying glass, for allowing the patient to take note of the angle of flex of the joint;

FIG. 6A is a side, elevational view of the passive flexion chair physical therapy apparatus of the present invention with an alternative embodiment of the back support of the chair of the invention;

FIG. 6B is an alternate perspective view illustrating the support structure of the invention allowing it to be free standing. With this support structure the invention can be manufactured so as to be portable.

FIG. 7 is a plan view of the passive flexion chair physical therapy apparatus of the present invention with features relating to the elevation means of the chair being shown in phantom, as well as alternative positions of the support bars being shown in phantom;

FIG. 8 is a prospective view of the elevator means, or pneumatic activator, electric activator, etc., of the present invention which provides vertical movement of the passive flexion chair apparatus of the present invention;

FIG. 9 is a cross-sectional, side view of the activator of the present invention, shown in FIG. 8, taken in elevation; and, FIG. 10 is a partial cross-sectional, side view of the relationship between adjacent segments of the activator of the present invention, as shown in FIG. 9. within circle designated by numeral "10."

DETAILED DESCRIPTION OF THE PREFERRED EMBODIMENT AND DRAWING

Figure 1:
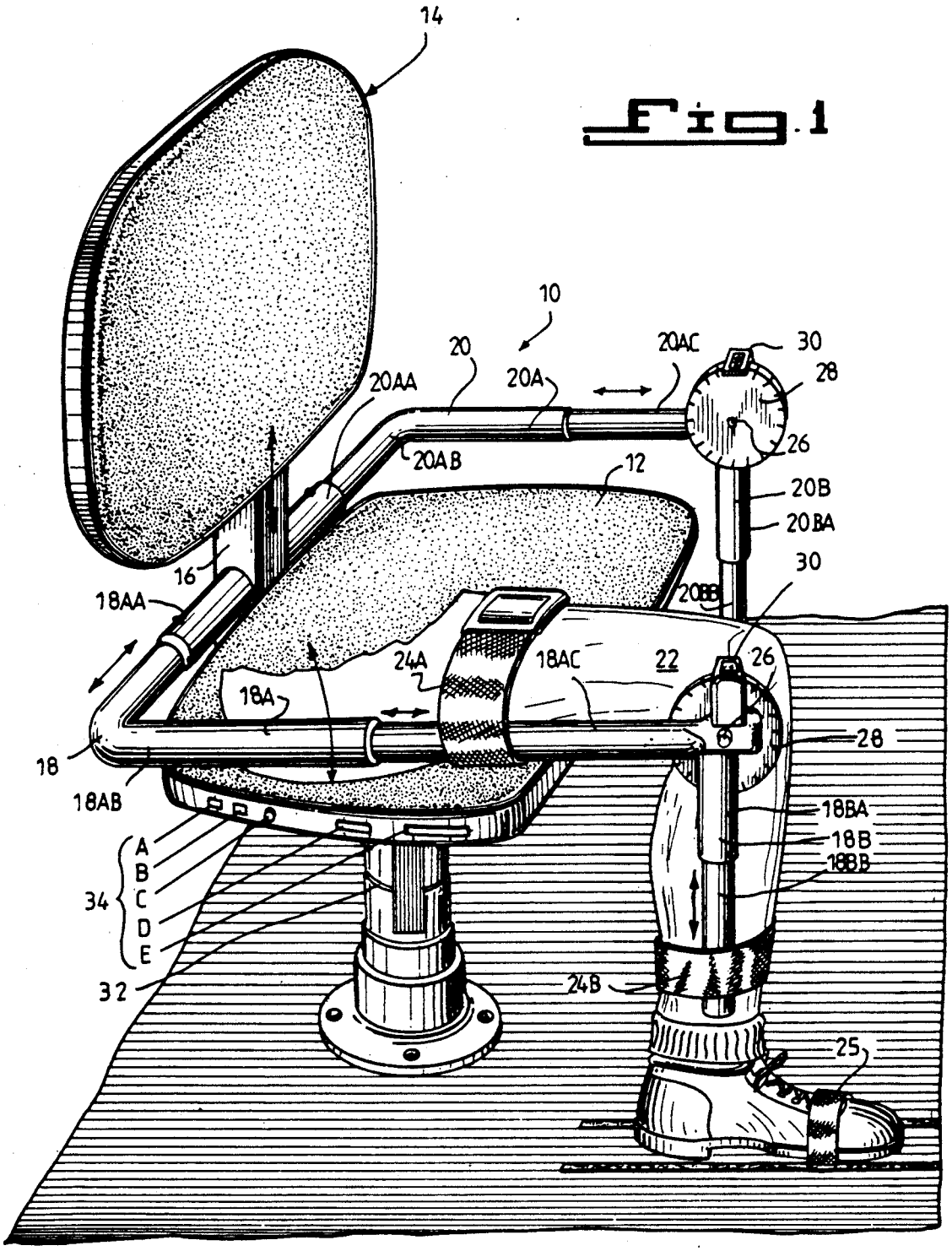
FIG. 1 is a prospective view of the passive flexion chair physical therapy apparatus of the present invention.

Turning now, in detail, to an analysis of the accompanying drawing figures, FIG. 1 is a prospective view of the passive flexion chair physical therapy apparatus 10 of the present invention. Passive flexion chair apparatus 10 includes a seat portion 12 with a back support 14, which is preferably in connection with seat portion 12 via beam 16.

Extending in opposite directions from beam 16, and substantially in parallel to the plane of back support 14, are support arms 18 and 20. Each support arm 18, 20, is preferably constructed of a horizontal portion and a vertical portion, designated by reference numerals 18A and 18B for support bar 18, respectively, and by numerals 20A and 20B for support bar 20, respectively. In turn, each of the horizontal and vertical portions of support arms 18, 20 are preferably comprised of telescoping segments designated by the reference numerals of 18AA, 18AB, 18AC, 18BA and 18BB, for support bar 18; and of reference numerals 20AA, 20AB, 20AC, 20BA and 20BB of support bar 20.

When in use, a patient would be seated in chair 12. Each leg (one leg of patient being designated by reference numeral 22) of the patient would be secured to a support bar, either support bar 18 or 20. Support would be provided along both portions 18A and 18B of support bar 18, and along both portions 20A and 20B of support bar 20. The preferred means for securing the patient's legs to the respective support bar would be, for example, by straps or belts 24A, 24B for support bar 18, with analogous means being provided for support bar 20 (not shown.)

A patient's foot may be secured to the ground by strap means 25, as illustrated in FIG. 1, which are preferably secured by a complementary portion of Velcro to the supporting floor itself.

The intersection between telescoping segments 18AA and 18AB of support bar 18 is designed to allow for a rotation between such segments as per the vertical movement of chair 12 and, of course, the height of the patient's lower leg 22.

The intersection between telescoping segments 18AB and 18AC permits a horizontal movements of said segments relative to one another, again, in response to the vertical movement of chair 12, as will be explained and shown in further detail by way of FIG. 3, described hereinafter.

Between horizontal portion 18A and vertical portion 18B of support bar 18 (the analogous arrangement existing as per support bar 20), there is provided a pivot 26 in order to permit movement of horizontal portion 18A relative to vertical portion 18B. The extent, or degree, of pivoting between portions 18A and 18B is shown by way of protractor 28, with magnification means 30, i.e., a magnifying glass, for readily determining the degree of flex of the patient's knee joint. Again, all features relative to support bar 18 are provided in an analogous manner for support bar 20.

Chair 12 is provided with elevator means 32 for the purpose of providing continuous or discontinous bidirectional, vertical movement. Such elevator means may, for example, be pneumatic elevator means, or any equivalent apparatus which will raise and lower chair 12 in a manner wherein the range from uppermost to lowermost points can be readily adjusted, as well as the frequency, or speed, of the elevator means.

In a preferred embodiment of the present invention, a control panel 34 is provided, preferably along a vertical side portion of chair 12. In FIG. 1, control panel 34 is shown with the designations of A–E. FIG. 2 provides a legend for a preferred type of control panel 34. Control "A" may, for example, designate an "up" control, while Control "B" may commence a "down" control.

The present invention may be constructed so that elevator means 32 for chair 12 is either continuous or discontinuous. In the latter mode, the patient may manually control the particular up-and-down movements of elevator means 32 or, alternatively, may allow automatic and pre-determined control of such elevator means in a timed manner.

Returning, again, to FIG. 2, Control "C," in the preferred embodiment of the present invention, may be designated to control the variable speed for elevator means 32 so as to effect various rates of descent.

Controls "D" and "E" in FIG. 2 are preferably provided to allow the patient to adjust the degree of descent, which must necessarily affect the degree of flex, either in intervals of 1° to 5°, as per Control "D," or the total setting of descent in degrees, as per Control "E."

FIG. 3, which includes FIGS. 3-A, 3-B, 3-C and 3-D provides various cross-sectional views of the passive flexion chair apparatus 10 of the present invention at differing degrees of descent. In FIG. 3-A, portions 18A and 18B of support bar 18 are at substantially a right angle to one another, i.e., the deviation of the patient's lower leg from the normal is 0°. The angle of deviation is therefore zero degrees and is represented by the symbol, $O_A$.

As the degree of descent in FIGS. 3-B, 3-C and 3-D increases progressively, the angle of deviation from the normal increases with $O_D > O_C > O_B > O_A$. The angle of deviation, or angle of flex, which may be measured from various reference points, as it will be noted, is directly effected and controlled by the amount of descent of chair 12 via elevator means 32.

A standard treatment program might involve starting a treatment program at an angle of deviation 0–10°, then increasing the angle of deviation, by adjusting the vertical movement of elevator means 32, so that the angle of deviation is incrementally increased on a monthly basis to 20°, then 30° and, finally, 40°.

FIG. 4 shows a prospective, rear view of the passive flexible chair physical therapy apparatus 10 of the present invention, which includes a back support 14, which is preferably adjustable via locking knob 15 vertically along vertical beam 16. Once the back support 14 and support bars are at a height suitable for the patient, it may be readily tightened with the back support being so secured.

FIG. 5 is a side, elevational view of the passive flexion chair physical therapy apparatus 10 of the present invention with the back support 14 of the chair 12 being shown in cross-section, partially broken away. Back support 14 may be conventionally constructed and may include a cushion 14A or other means for the comfort of the patient.

FIG. 6 is a prospective view illustrating the protractor 28 of the invention, which is provided at the joint, or pivot 26 of the support bar 18, with the protractor 28 having magnification means, such as a magnifying glass 30, for allowing the patient to take note of the angle of flex of the joint. The angle of flex, O, may be measured in the manner as shown in FIG. 3.

FIG. 6A is a side, elevational view of the passive flexion chair physical therapy apparatus 10 of the present invention with an alternative embodiment of the back support 14 of the chair 12 of the invention. In the alternative, preferred embodiment shown, back support 14 is made adjustable by providing a sleeve which includes holes which would line up so that the locking knob 15 would engage one hole for a given height.

FIG. 6B is an alternate prospective view illustrating the support structure of the invention allowing it to be free standing. With this support structure the invention can be fabricated so that it may be portable.

FIG. 7 is a plan view of the passive flexion chair physical therapy apparatus 10 of the present invention with features relating to the elevation means 32 of the chair 12 being shown in phantom, as well as alternative positions of the support bars 18 and 20 being shown in phantom. With respect to support bars 18 and 20, each bar includes a telescoping connection between support bar segments 18AA and 18AB of support bar 18, and analogous support bar segments 20AA and 20AB of support bar 20. The foregoing telescoping connection allows for adjustment of the distance between support bars 18 and 20 to best fit the patient.

FIG. 8 is a prospective view of the elevator means 32, or activator, of the present invention which provides vertical movement of the passive flexible chair apparatus 10 of the present invention. The activator unit 32 shown in FIG. 8 represents a preferred means for the elevator means, described above, for vertical movement of chair 12. The activator 32, as shown in FIG. 8, has a telescoping construction which allows for a smooth and particularly wide degree of vertical movement. The activator may be pneumatic or any other type such as electric with any type of gearing.

Further shown in FIG. 8 is control panel 34, with Controls A–E, as previously described.

FIG. 9 is a cross-sectional, side view of the activator 32 of the present invention, shown in FIG. 8, taken in elevation. The activator 32 includes a return spring as well as telescoping, or concentric, segments 36*a*, 36*b*, 36*c* for controlling vertical movement of chair 12.

Finally, FIG. 10 is a partial cross-sectional, side view of the relationship between adjacent segments 36*a*, 36*b* of the activator of the present invention, as shown in FIG. 9. within circle designated by numeral "10." The interlocking construction of adjacent concentric segments is shown, which would exist when the activator 32 is fully extended to its maximum height.

While only several embodiments of the present invention have been shown and described, it will be obvious to those of ordinary skill in the art that many modifications may be made to the present invention without departing from the spirit and scope thereof.

LIST OF REFERENCE NUMERALS

10 passive flexion chair physical therapy apparatus
12 chair portion
14 back support
15 locking knob of back support
16 vertical beam
18 right support arm/bar
18AA, 18AB, 18AC right support arm/bar horizontal segments
18BA, 18BB right support arm/bar vertical segments
20 right support arm/bar
20AA, 20AB, 20AC right support arm/bar horizontal segments 20BA, 20BB right support arm/bar vertical segments
22 right leg of patient
24A, 24B securing straps/belts for supporting arm/-bar 18
25 supporting strap for foot of patient
26 support arm/bar pivot
28 protractor
30 magnification means for protractor
32 elevator/activator means
34 control panel with Controls A, B, C, D, E
36*a*, 36*b*, 36*c* telescoping segments of activator It will be understood that each of the elements described above, or two or more together, may also find a useful application in other types of methods differing from the type described above.

While certain novel features of the present invention have been shown and described and are pointed out in the annexed claims, the present invention is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will be fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A passive flexion chair apparatus for use in physical therapy, comprising:

base means for positioning on a supporting floor;

a seat upon which a patient to be treated would be seated during a treatment, said seat having a left side and a right side;

a pair of support arms with one of said pair of support arm being located on the left side of said seat and another of said pair of support arms being located on the right side of said seat, said pair of support arms including means for continually adjusting to vertical movements of the patient in said seat;

first means for securing each of said support arms to a leg of the patient;

second means for securing the patient's leg to the supporting floor during treatment;

means for providing vertical movement to the patient seated in said seat with respect to said base means and said second means during the treatment in both an ascending direction and a descending direction; and, means for controlling said means for providing vertical movement.

2. The passive flexion chair apparatus for use in physical therapy according to claim 1, wherein said seat includes a back support.

3. The passive flexion chair apparatus for use in physical therapy according to claim 2, wherein said back support is provided with means for selectively positioning said back support with respect to said seat.

4. The passive flexion chair apparatus for use in physical therapy according to claim 1, wherein said pair of support arms is made of a series of concentric segments as said means for adjusting and said means for continually adjusting.

5. The passive flexion chair apparatus for use in physical therapy according to claim 1, wherein each of said support arms of said pair of support arms includes means for determining an angle of deviation of movement of the patient's knee joint, said angle of deviation of movement being measured relative to a fixed point.

6. The passive flexion chair apparatus for use in physical therapy according to claim 5, wherein said angle of deviation of movement is measured relative to the normal.

7. The passive flexion chair apparatus for use in physical therapy according to claim 1, wherein said first means for securing and said second means for securing is a plurality of straps.

8. The passive flexion chair apparatus for use in physical therapy according to claim 1, wherein said means for providing vertical movement includes a pneumatic activator.

9. The passive flexion chair apparatus for use in physical therapy according to claim 1, wherein said means for providing vertical movement are discontinuous and controlled by manual means.

10. The passive flexion chair apparatus for use in physical therapy according to claim 1, wherein said means for controlling includes means for incrementally adjusting the vertical movement of said seat by degree of angle of deviation.

11. The passive flexion chair apparatus for use in physical therapy according to claim 10, wherein said means for incrementally adjusting the vertical movement of said seat is by 1-degree increments.

12. The passive flexion chair apparatus for use in physical therapy according to claim 10, wherein said means for incrementally adjusting the vertical movement of said seat is by 5-degree increments.

13. The passive flexion chair apparatus for use in physical therapy according to claim 1, wherein said means for providing vertical movement includes an electric motor activator.

* * * * *